US005311810A

United States Patent [19]

Takada et al.

[11] Patent Number: 5,311,810

[45] Date of Patent: May 17, 1994

[54] RODLESS CYLINDER

[75] Inventors: Yoshiyuki Takada, Tokyo; Michikazu Miyamoto, Ibaraki, both of Japan

[73] Assignee: SMC Kabushiki Kaisha, Tokyo, Japan

[21] Appl. No.: 969,449

[22] Filed: Oct. 30, 1992

[30] Foreign Application Priority Data

Nov. 1, 1991 [JP] Japan ..... 3-288121

[51] Int. Cl.[5] ..... F01B 29/00

[52] U.S. Cl. ..... 92/88; 92/165 R; 277/DIG. 7

[58] Field of Search ..... 92/88, 165 R; 384/49

[56] References Cited

U.S. PATENT DOCUMENTS

| | | | |
|---|---|---|---|
| 2,200,427 | 5/1940 | Merz | 92/88 |
| 3,820,446 | 6/1974 | Granbom et al. . | |
| 4,373,427 | 2/1983 | Garlapaty et al. . | |
| 4,555,980 | 12/1985 | Hoglund . | |
| 4,856,415 | 8/1989 | Noda | 92/88 |
| 5,111,913 | 5/1992 | Granbom | 92/88 |

FOREIGN PATENT DOCUMENTS

| | | | |
|---|---|---|---|
| 0104364 | 4/1984 | European Pat. Off. . | |
| 0135041 | 3/1985 | European Pat. Off. . | |
| 0177850 | 4/1986 | European Pat. Off. . | |
| 0177880 | 4/1986 | European Pat. Off. . | |
| 234033 | 9/1987 | European Pat. Off. . | |
| 0294350 | 12/1988 | European Pat. Off. . | |
| 0476265 | 3/1992 | European Pat. Off. . | |
| 3124915 | 1/1983 | Fed. Rep. of Germany . | |
| 3802703 | 8/1988 | Fed. Rep. of Germany . | |
| 3812505 | 11/1988 | Fed. Rep. of Germany | 384/49 |
| 106408 | 5/1988 | Japan | 92/88 |
| 859821 | 1/1961 | United Kingdom | 384/49 |

OTHER REFERENCES

Patent Abstracts of Japan, vol. 12, no. 109(M-682), Apr. 8, 1988, & JP-A-62-237-103, Oct. 17, 1987, Mizuno Kanji, "Pressurized Fluid Cylinder".

VDI Zeitschrift, vol. 129, no. 5, May 1987, pp. 104-108, V. K. Gerwers.

*Primary Examiner*—Thomas E. Denion

*Attorney, Agent, or Firm*—Oblon, Spivak, McClelland, Maier & Neustadt

[57] ABSTRACT

The present invention provides a rodless cylinder capable of displacing a piston without its operation stoppage in particular even when a large load or force is applied, smoothly reciprocating a sliding table and forming its entire structure in a compact manner. The rodless cylinder according to the present invention has a cylinder body and an L-shaped sliding table. A rail-shaped member fitted on a linear guide member of the sliding table is mounted on the upper surface of the cylinder body, which is held against the sliding table, so as to extend along the longitudinal direction of the cylinder body. A plurality of ball bearings are linearly disposed inside the linear guide member held in engagement with the rail-shaped member so as to extend along the longitudinal direction of the linear guide member.

14 Claims, 8 Drawing Sheets

RODLESS CYLINDER

BACKGROUND OF THE INVENTION

1. Field of the Invention

The present invention relates to a rodless cylinder, and more specifically to a rodless cylinder wherein the load applied to a sliding table which is disposed outside a cylinder and displaced in accordance with the reciprocating motion of a piston, can be dispersed and supported on the cylinder side, thereby making it possible to smoothly move the sliding table in accordance with the reciprocating motion of the piston.

2. Description of the Related Art

A rodless cylinder has recently been used in various ways as a workpiece feeding device in a factory or the like.

The rodless cylinder can have a reduced stroke as compared with a cylinder with a rod coupled thereto. Thus, the area occupied by the rodless cylinder is small and the rodless cylinder is easy to handle. The rodless cylinder can also prevent dust or the like from entering as compared with the rod-coupled cylinder referred to above. As a result, a highly-accurate positioning operation can be effected. The rodless cylinder normally comprises a cylinder body having a slit defined therein so as to extend along the longitudinal direction thereof, and a sliding table. A piston loaded into the cylinder body is formed integrally with the sliding table by a connecting member.

This type of rodless cylinder has been disclosed in U.S. Pat. No. 4,373,427 or DE-PS 3,124,915, for example. In particular, the rodless cylinder described in DE-PS 3,124,915 is constructed such that a guide groove is defined in a given portion located outside a cylinder tube and a guiding means mounted to a leg which extends toward the given portion from the ends of the sliding table, is fitted in the guide groove. According to DE-PS 3,124,915, when a lateral force is applied, the guiding means is held against the guide groove so as to avoid an increase in width of a slit.

According to DE-PS 3,124,915, however, the leg should be disposed so as to extend toward a position far spaced from the outer side of the cylinder tube as seen from the sliding table and to hold the guiding means.

When the guiding means is fitted in the guide groove upon application of the lateral force under this construction, one end face of the cylinder tube, which defines the slit, forcibly approaches the other end face of the cylinder tube, which defines a slit on the opposed side. Thus, the inside diameter of a bore defined in the cylinder tube is reduced as a whole so that a piston is forcibly inactivated. That is, the piston stops moving when the lateral force is applied. In other words, a workpiece feeding operation is unexpectedly stopped, thereby causing a problem in that a workpiece held in engagement with the sliding table cannot be smoothly fed.

SUMMARY OF THE INVENTION

It is a general object of the present invention to provide a rodless cylinder capable of avoiding a reduction in diameter of a slit defined in a cylinder tube particularly even when unexpected forces are applied from horizontal and vertical directions, activating a piston at all times and smoothly reciprocating a sliding table.

It is another object of the present invention to provide a rodless cylinder comprising a cylinder body having a slit defined therein which extends along the longitudinal direction of a cylinder tube whose ends are closed and which enables a bore defined in the cylinder body to communicate with the outside, a piston reciprocatively moved within the bore of the cylinder body, a sliding table coupled to the piston by a connecting portion extending through the slit and moved in accordance with the reciprocating motion of the piston, and first and second sealing members held in engagement with the piston and/or the sliding table so as to close the slit. The sliding table has first and second surfaces which are subjected to loads from different directions respectively. Further, the cylinder body has a first guide member mounted on a first side thereof, which is opposed to the first surface of the sliding table, and a second guide member mounted on a second side of the cylinder body, which is opposed to the second surface of the sliding table. Furthermore, the sliding table includes a first support member provided on the first surface thereof so as to be held in engagement with the first guide member of the cylinder body and a second support member provided on the second surface thereof so as to be held in engagement with the second guide member. The first and second support members serve to disperse and support the loads when the loads are applied from the same direction.

It is a further object of the present invention to provide a rodless cylinder wherein the first and second guide members comprise rail-shaped members respectively.

It is a still further object of the present invention to provide a rodless cylinder wherein the first support member comprises a linear guide member and the second support member comprises a guide roller.

It is a still further object of the present invention to provide a rodless cylinder wherein the first guide member comprises a first rail-shaped member held in engagement with the linear guide member which serves as the first support member and the second guide member comprises a second rail-shaped member held in engagement with the guide roller which serves as the second support member.

It is a still further object of the present invention to provide a rodless cylinder wherein the linear guide member has a plurality of ball bearings disposed substantially at equal intervals.

It is yet another further object of the present invention to provide a rodless cylinder wherein the rail-shaped member used as the second guide member, is mounted on a third surface parallel to the rail-shaped member used as the first guide member.

It is a still further object of the present invention to provide a rodless cylinder wherein the third surface is formed on an extension which projects from the cylinder body.

It is a still further object of the present invention to provide a rodless cylinder wherein the sliding table has first and second surfaces used to receive loads thereon from different directions respectively, and a first guide member and a first support member held in engagement with the first guide member are mounted on a first side of a cylinder body and the first surface of the sliding table respectively, the first support member serving to support any load applied from all directions when the loads are applied to the sliding table from the different directions.

It is a still further object of the present invention to provide a rodless cylinder wherein the first guide member has slanted surfaces formed so as to extend towards each other and to bear any load applied to the sliding table from all directions.

The above and other objects, features and advantages of the present invention will become apparent from the following description and the appended claims, taken in conjunction with the accompanying drawings in which preferred embodiments of the present invention are shown by way of illustrative example.

DESCRIPTION OF THE PREFERRED EMBODIMENTS

Figure 1:
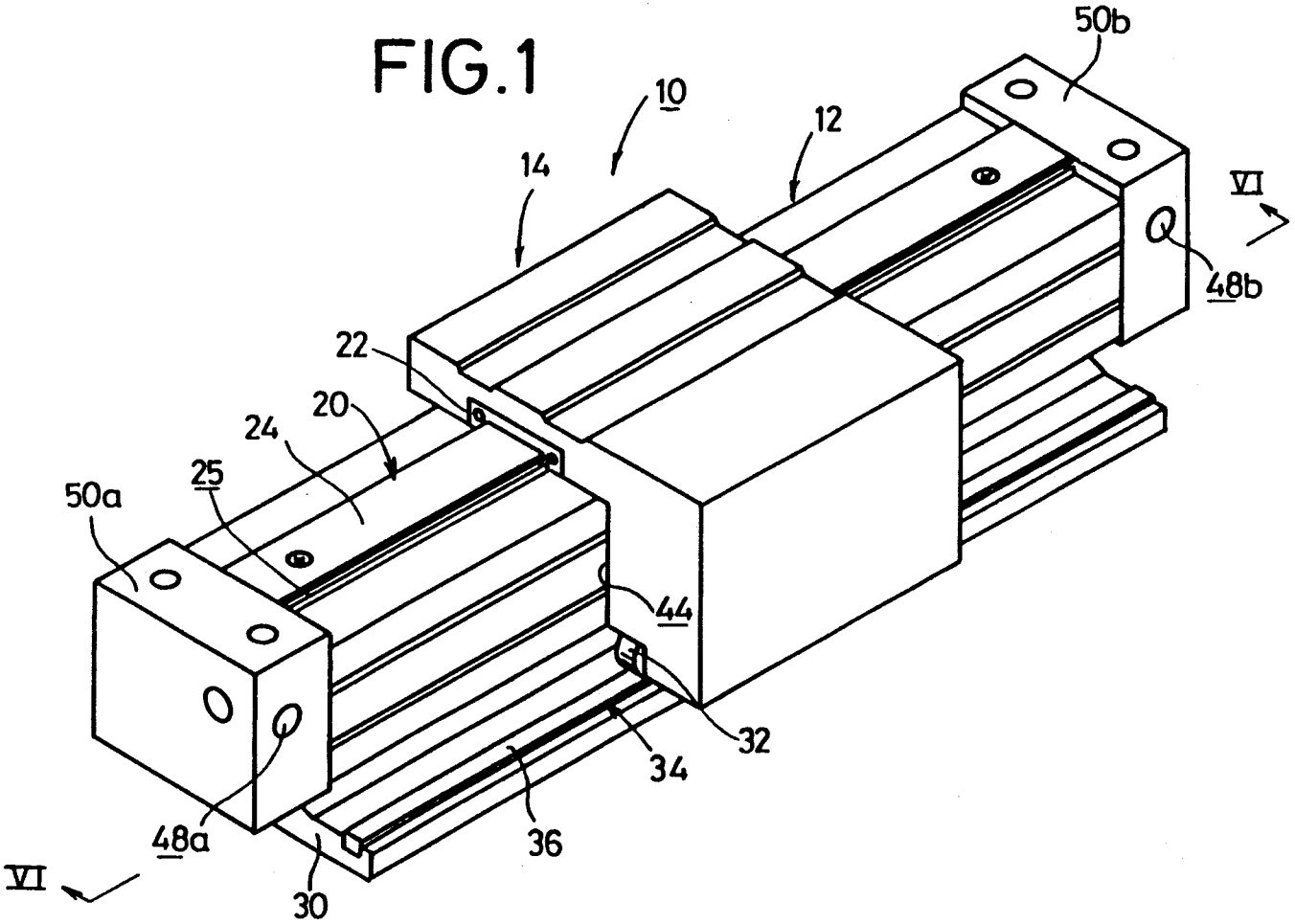
FIG. 1 is a perspective view showing a rodless cylinder according to one embodiment of the present invention.
Figure 2:
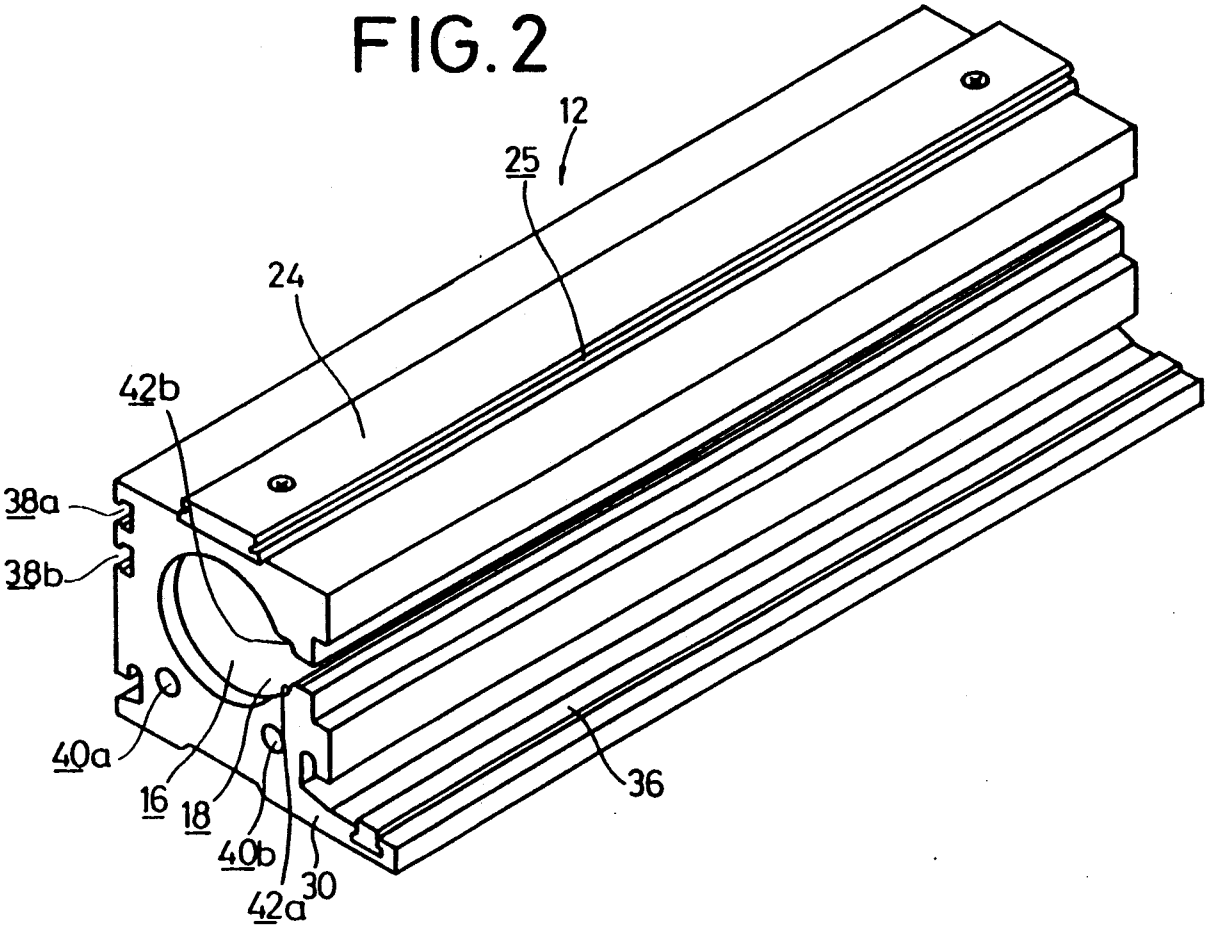
FIG. 2 is a perspective view illustrating a body of the rodless cylinder shown in FIG. 1.

In FIG. 1, reference numeral 10 indicates a rodless cylinder according to one embodiment of the present invention. The rodless cylinder 10 comprises a cylinder body 12 and an L-shaped sliding table 14. The cylinder body 12 has a bore 16 which is defined therein and extends along the longitudinal direction thereof (see FIG. 2). The bore 16 communicates with the outside through a slit 18 which is defined in one side of the cylinder body 12 and extends along the longitudinal direction thereof. A first support member 20, which is held in engagement with a linear guide member 22 mounted to the sliding table 14, is formed on the upper surface of the cylinder body 12, which is held against the sliding table 14. The first support member 20 comprises a rail-shaped member 24 having dovetail cross-sectional, i.e., enlarged slant surfaces 23*a*, 23*b* which extend along the longitudinal direction of the cylinder body 12. The rail-shaped member 24 has opposed grooves 25 used to receive a plurality of ball bearings 26 therein and linearly defined in both sides thereof along the longitudinal direction thereof (see FIG. 2). On the other hand, the cylinder body 12 has an extension 30 which has a surface parallel to the upper surface of the cylinder body 12 and projects from the slit 18 side. The extension 30 has a rail 36 which is formed on the surface thereof so as to extend along the longitudinal direction thereof and be held in engagement with a pair of roll bearings 32, 32 mounted to the ends of the sliding table 14 so as to form a second support member 34. Each of the roll bearings 32 may be replaced by a cam follower.

Figure 3:
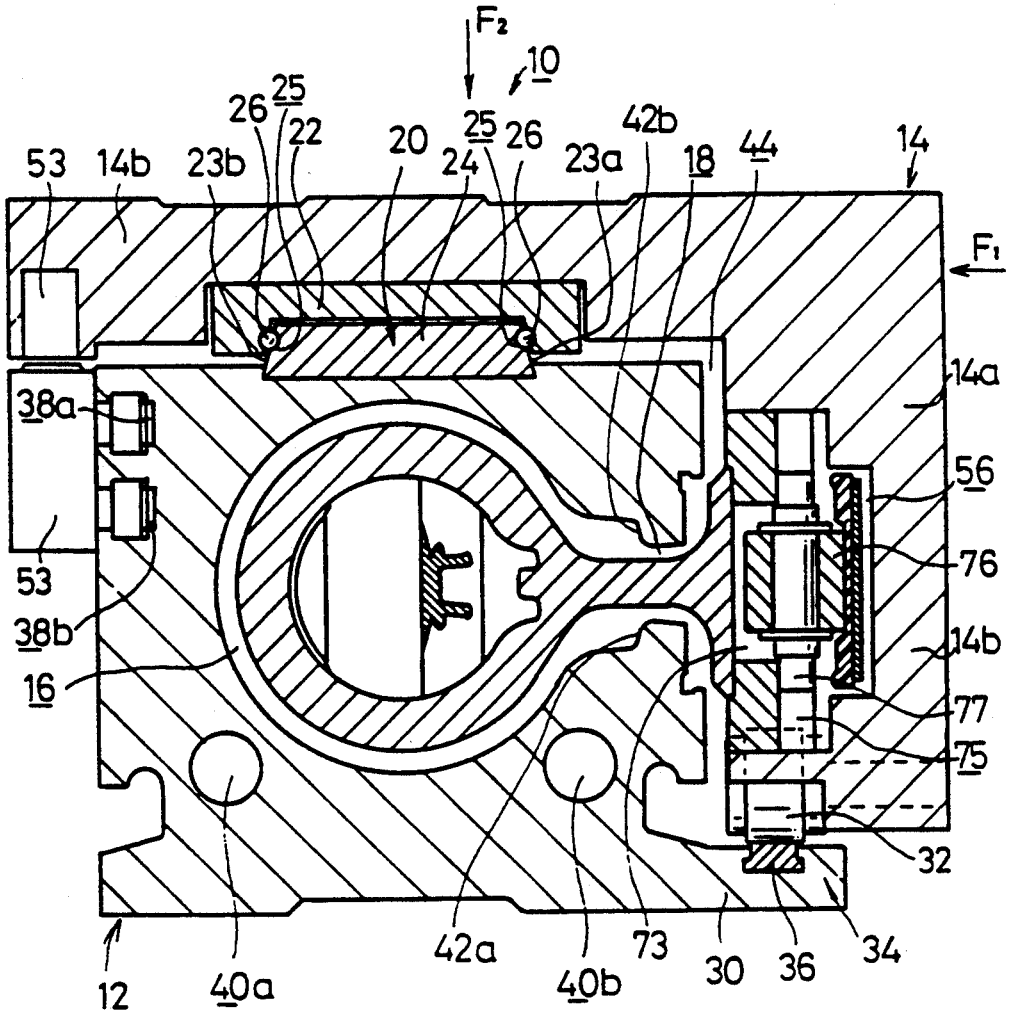
FIG. 3 is a vertical cross-sectional view showing the body of the rodless cylinder shown in FIG. 1 and a sliding table thereof.

As shown in FIG. 3, elongated grooves 38*a*, 38*b*, which extend along the longitudinal direction of the cylinder body 12 and are used to fit at least one sensor thereon, are defined in one side of the cylinder body 12, which is opposite to the extension 30. Further, fluid passages 40*a*, 40*b* used for centralized piping are defined in the cylinder body 12 so as to extend along the longitudinal direction thereof.

As described above, the slit 18 enables the bore 16 and the outside to communicate with each other. However, steps 42*a*, 42*b* are provided in continuation with their corresponding parallel wall surfaces 92*a*, 92*b* for defining the slit 18, and are formed so as to spread out toward the bore 16. Referring to FIG. 3, a surface, which vertically extends on the side opposite the bore 16 from the wall surfaces 92*a*, 92*b* of the slit 18, is formed as a vertical surface, which is in turn used so as to define an interval or gap 44 between the vertical face and the slide table 14.

Both ends of the cylinder body 12 constructed as described above are airtightly closed by end caps 50*a*, 50*b* with ports 48*a*, 48*b* defined therein, respectively (see FIG. 1). In this case, a piston can be displaced by making use of either one of the fluid passages 40*a*, 40*b*, e.g., the fluid passage 40*a* without defining the port 48*b* in the end cap 50*b* or by closing the port 48*b* with a blank cap. In this case as well, a port different from the port 48*a* can be defined in the end cap 50*a* so as to communicate with the fluid passage 40*a*. That is, if the other end of the fluid passage 40*a* is opened within the bore 16 on the end cap 50*b* side, the piston can be displaced. Incidentally, reference numeral 53 in FIG. 3 indicates a sensor for detecting the position of either the piston or the sliding table 14.

Figure 4:
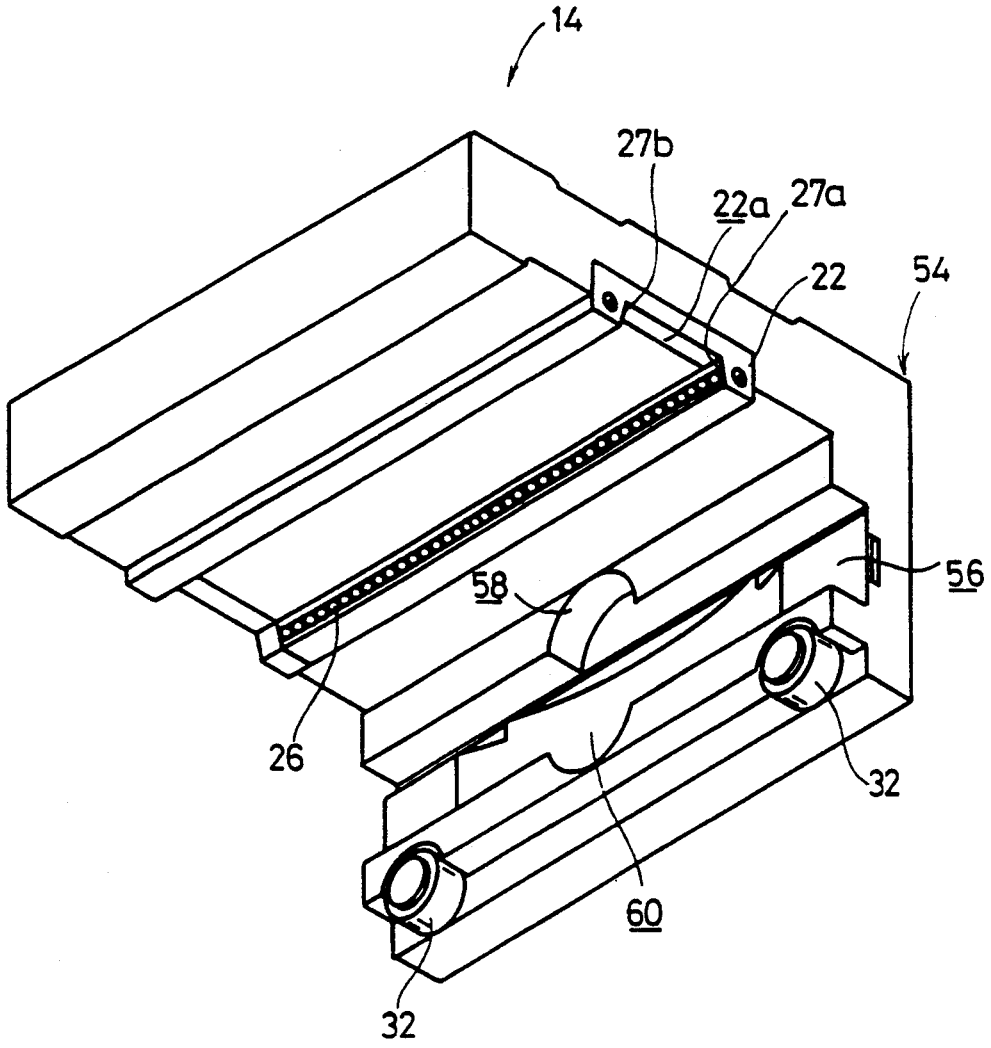
FIG. 4 is a perspective view depicting the sliding table of the rodless cylinder shown in FIG. 1.

The sliding table 14 will be next be described. As shown in FIGS. 3 and 4, the sliding table 14 comprises an L-shaped and relatively thick block 54. A linear guide member 22 held against the rail-shaped member 24 is mounted on a plate having one side or leg 14*b* of the block 54, which is opposite to the upper surface of the cylinder body 12, so as to extend along the longitudinal direction of the sliding table 14. A plurality of ball bearings 26 are linearly disposed inside the linear guide member 22 at equal intervals. As is apparent from the drawing, the linear guide member 22 has enlarged slant surfaces 27*a*, 27*b* formed therein, which extend in a facing relationship to the slant surfaces 23*a*, 23*b* of the rail-shaped member 24. On the other hand, a groove 56 is defined in the center of a plate having the other side or leg 14*a* of the sliding table 14 so as to extend along the longitudinal direction of the sliding table 14. An elliptically-enlarged space 58 is defined substantially in the center of the groove 56. As is apparent from FIG. 4, the groove 56 has a concave portion 60 curved toward the surface of the block 54 shown in FIG. 3, which is opposite to the cylinder body 12. The pair of roll bearings 32, 32, which are held in engagement with the rail 36 mounted on the extension 30 of the cylinder body 12 so as to form the second support member 34 as described above, are mounted to the end of the side 14*a* of the plate of the block 54.

Figure 5:
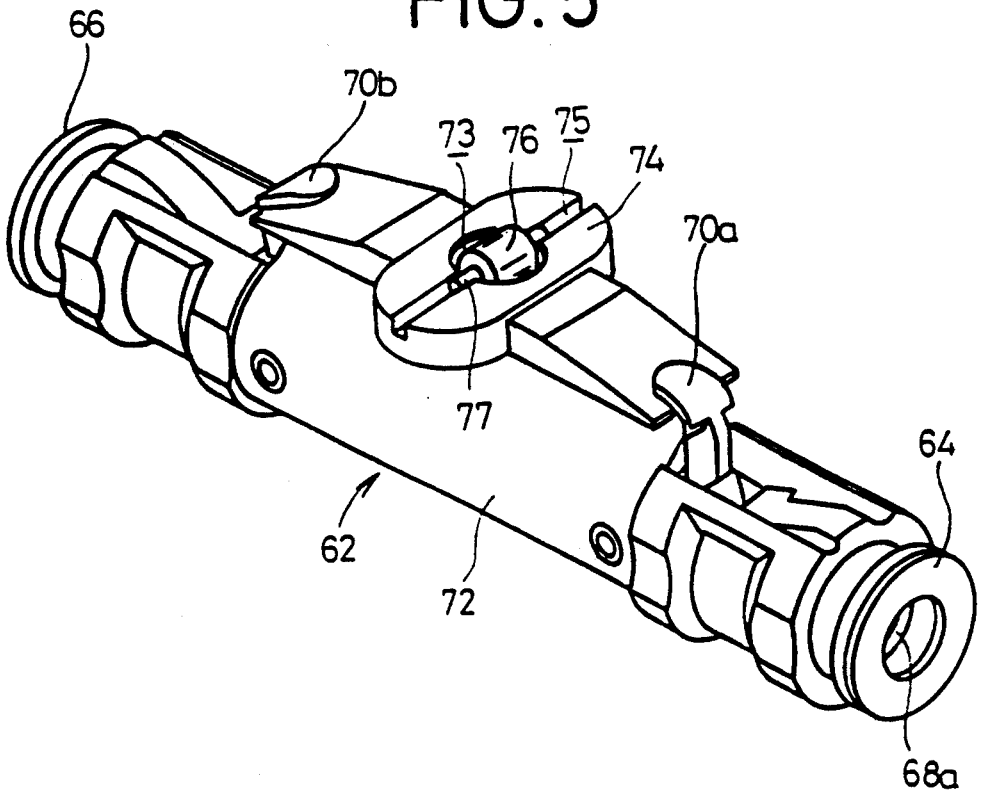
FIG. 5 is a perspective view illustrating a piston employed in the rodless cylinder shown in FIG. 1.

FIG. 5 shows a piston 62. The piston 62 has a first pressure-receiving surface 64 and a second pressure-receiving surface 66 formed on the side opposite the first pressure-receiving surface 64. Further, the piston 62 has cushion seals 68*a*, 68*b* provided therein (see FIG. 5). Belt separators 70*a*, 70*b* are disposed above the cylindrical piston and fixedly mounted on a piston yoke 72. A coupler 74 having a circular space 73 defined centrally therein is formed in an expanded state so as to be placed above the piston yoke 72. A roller 76 is rotatably supported by the coupler 74. That is, a groove 75 is defined in the elliptical coupler 74 along the major axis of the coupler 74, and a shaft 77 of the roller 76 is fitted in the groove 75. Accordingly, the roller 76 can be rotated within the space 73. As is apparent from FIG. 6, scrapers 78*a*, 78*b* are provided inside the sliding table 14. In this case, the coupler 74 is fitted in the space 58. Incidentally, reference numeral 80 in FIG. 6 indicates a passage for inserting a first sealing member to be described later into the piston, whereas reference numeral 82 indicates a cushion ring.

Figure 7:
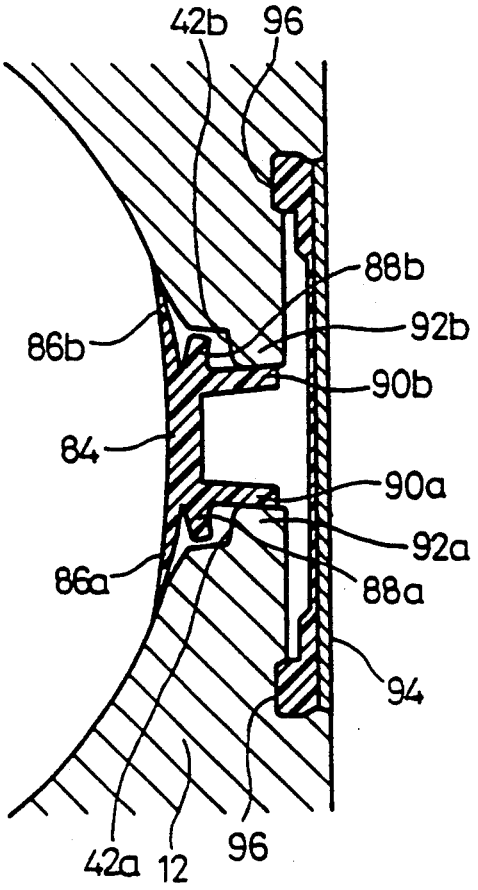
FIG. 7 is a partly cut vertical cross-sectional view showing the manner of fitting of a first sealing member employed in the rodless cylinder shown in FIG. 1 in a slit.

A first sealing member 84 fitted on the steps 42*a*, 42*b* will next be shown in FIG. 7. The first sealing member 84 has tongues 86*a*, 86*b* and extensions 88*a*, 88*b* which are disposed above the tongues 86*a*, 86*b* respectively. Further, the first sealing member 84 has engaging portions 90*a*, 90*b* which extend so as to be directed upward from the extensions 88*a*, 88*b* and slightly enlarged in an upward direction. The extensions 88*a*, 88*b* are used so as to be held in engagement with the steps 42*a*, 42*b* when internal pressure is applied to the piston. Further, the engaging portions 90*a*, 90*b* are held against the wall surfaces 92*a*, 92*b* which define the slit 18. The first sealing member 84 is integrally formed of a flexible synthetic resin as a whole. On the other hand, a second sealing member 94 is used to close the slit 18. The second sealing member 94 is fitted in opposed grooves 96 which extend along the longitudinal direction of the cylinder body 12 from a position above the slit 18 defined in the upper end of the cylinder body 12. Incidentally, the first sealing member 84 is inserted into the passage 80 of the piston 62, and both ends of the first sealing member 84 are fixed to the end caps 50*a*, 50*b* together with the second sealing member 94.

The rodless cylinder 10 according to the present invention is basically constructed as described above. The operations and effects of the rodless cylinder 10 will next be described below.

Figure 6:
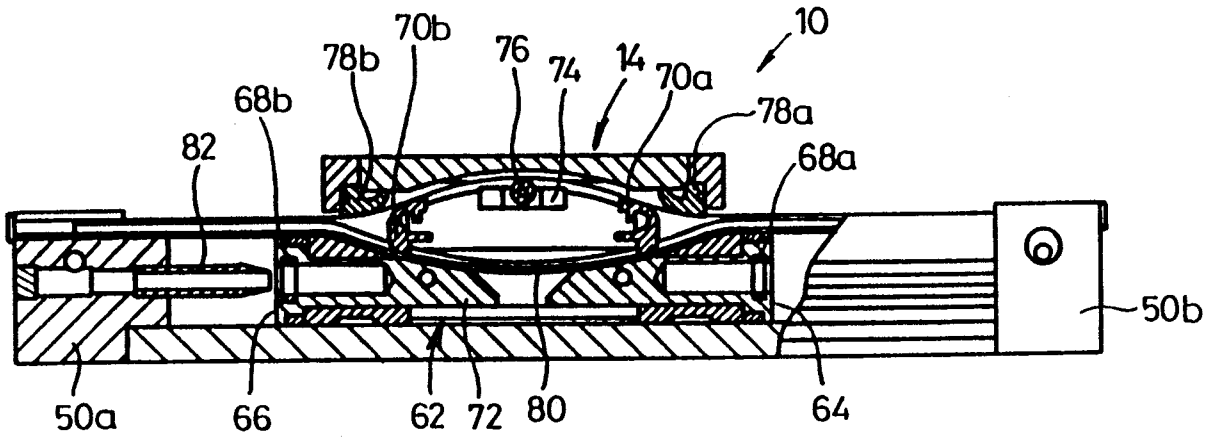
FIG. 6 is a cross-sectional view taken along line VI—VI of FIG. 1.

When compressed air is introduced from the port 48*a*, the compressed air passes through a path or passage defined in the cushion ring 82 and is pressed against the second pressure-receiving surface 66. Thus, the piston 62 is displaced to the right as seen in FIG. 6. Since the coupler 74 has been fitted in the space 58 of the sliding table 14 at this time, the piston 62 integrally displaces the sliding table 14 and moves it to the right in a manner similar to the displacement of the piston 62 to the right. At this time, the belt separators 70*a*, 70*b* are activated to cause the first sealing member 84 and the second sealing member 94 to be spaced away from each other between the sliding table 14 and the piston 62. Thus, when a workpiece is placed on the sliding table 14, for example, the workpiece can be moved to the right as seen in FIG. 6. It is needless to say that when the compressed air is introduced into the port 48*b*, the action opposite to the above action is effected.

Incidentally, the roller 76 is brought into sliding contact with the second sealing member 94 in the course of rotational motion of the roller 76 to facilitate the movement of the second sealing member 94.

Where an unexpected load, e.g., an unexpected load $F_1$ applied from the direction indicated by the arrow in FIG. 3 is now exerted on the sliding table 14 when the workpiece is fed under the action of displacement of the piston 62, the load $F_1$ is transmitted or applied to one side of the linear guide member 22 of the first support member 20 from the side 14*a* of the sliding table 14, and then transferred to the rail-shaped member 24 through the ball bearings 26.

When a load $F_2$ is applied to the side 14*a* of the sliding table 14 from the direction indicated by the arrow in FIG. 3, the load $F_2$ is directly transferred to the extension 30 of the cylinder body 12 from the roll bearing 32 of the second support member 34 through the rail 36. It is thus possible to avoid a situation in which when horizontal and vertical forces are applied to the sliding table in such a drawing as shown in the prior art, for example, the inside diameter of the bore 16 is reduced so that the frictional force increases between the bore 16 and the piston 62, thereby inactivating the piston 62 in the course of feeding of a workpiece toward a desired position.

Incidentally, the sensor 53 detects the positions of the piston 62 and the sliding table 14.

Figure 8:
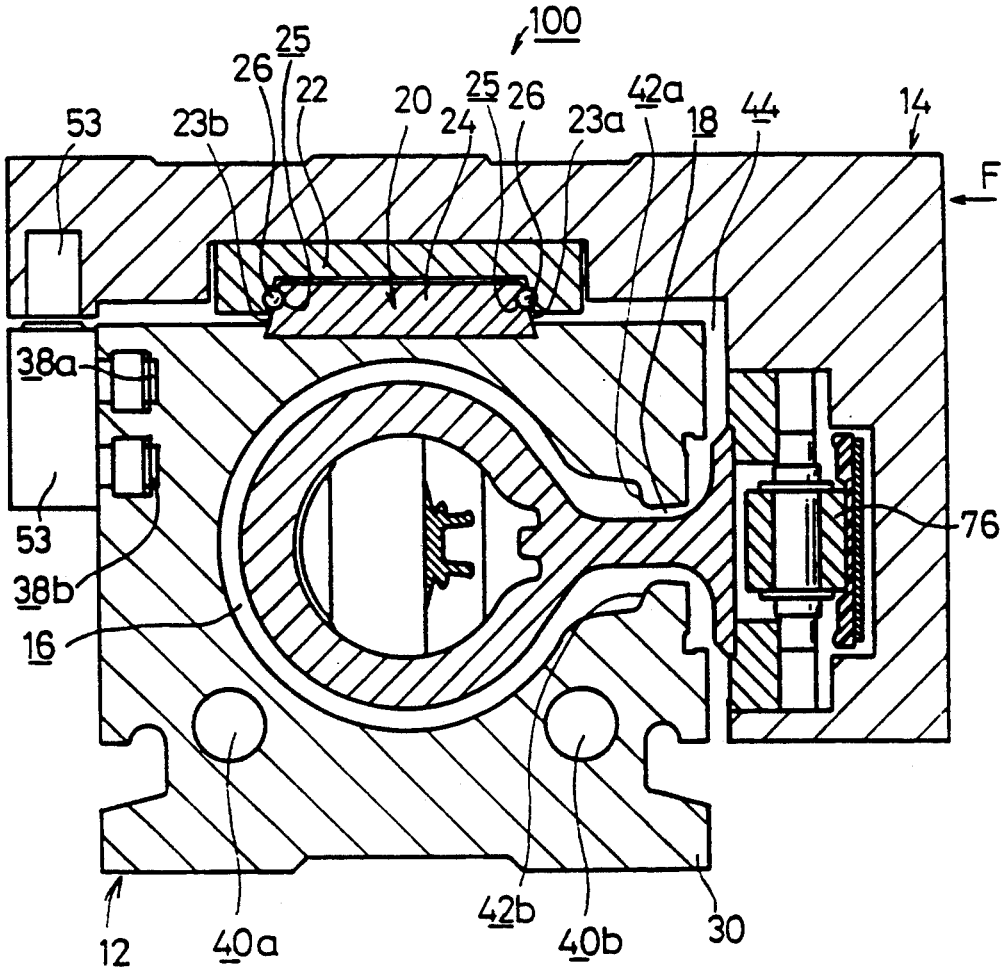
FIG. 8 is a vertical cross-sectional view showing both a body and a sliding table of a rodless cylinder according to another embodiment, which is different from the rodless cylinder shown in FIG. 1.

Further, another embodiment will be shown in FIG. 8. A rodless cylinder 100 according to the present embodiment is substantially identical in structure to the rodless cylinder 10 except for the second support member 34, the rail 36 and the roll bearings 32 all of which are employed in the rodless cylinder 10. Thus, the same structural elements as those employed in the rodless cylinder 10 are identified by like reference numerals and their detail description will therefore be omitted.

When a load $F_1$ is applied to a sliding table 14 from the direction indicated by the arrow under the above construction, a slant surface 23*a* of a rail-shaped member 24 can receive the load $F_1$. In particular, this type of structure is used when the load applied to the sliding table 14 is relatively low. Since the number of parts can be reduced, the rodless cylinder 100 can be manufactured at a low cost.

According to the present invention as described above, even if any load is applied to the sliding table from the vertical and horizontal directions, either the sliding table or the piston moved in unison with the sliding table can be smoothly displaced without its operation stoppage.

Having now fully described the invention, it will be apparent to those skilled in the art that many changes and modifications can be made without departing from the spirit or scope of the invention as set forth herein.

What is claimed is:

1. A rodless cylinder comprising:

a cylinder body with a cylinder tube, including a first side surface and second side surface having a slit defined therein, said slit extending along the longitudinal direction of said cylinder tube, said cylinder tube having ends which are closed and said slit enabling a bore portion of said cylinder body to communicate with an extension portion of said cylinder body;

a piston reciprocatively moveable within said bore of said cylinder body;

a substantially L-shaped sliding table having a first leg with a first surface and a second leg with a second surface and being coupled to said piston by a connecting portion extending through said slit and moved in accordance with the reciprocating motion of said piston;

a guide member provided at said first side surface of said cylinder body, which is opposed to said first surface of said sliding table and guiding thereof; and first and second sealing members engaged with said piston and said sliding table, respectively, so as to close at least a portion of said slit;

wherein when compressed fluid is fed to a pressure receiving portion of said piston, said sliding table is moved in a direction to which said piston is moved through said connecting portion under guidance of said guide member.

2. A rodless cylinder according the claim 1, wherein said guide member is engaged with a support member provided on said sliding table.

3. A rodless cylinder according to claim 2, wherein said support member comprises a linear guide member.

4. A rodless cylinder according to claim 3, wherein said linear guide member has a plurality of bearings.

5. A rodless cylinder according to claim 1, wherein a third side surface is provided on said cylinder body wherein a load is dispersed to said first surface and said third surface when the load is imposed against said first leg.

6. A rodless cylinder according to claim 5, wherein said third surface is provided at a projection projected from said cylinder body.

7. A rodless cylinder according to claim 6, wherein said third surface is substantially parallel to said first surface.

8. A rodless cylinder according to claim 7, wherein a further guide member is provided on said third surface.

9. A rodless cylinder according to claim 8, wherein said guide member provided on said first surface comprises a first rail-shaped member whilst said guide member provided on said third surface comprises a second rail-shaped member.

10. A rodless cylinder according to claim 9, further including a first support member and a second support member both of which are mounted on said slide table wherein said first support member comprises a linear guide member held in engagement with said first rail member and said second support member comprises a guide roller held in engagement with said second rail member.

11. A rodless cylinder according the claim 1, wherein said first leg is thinner than said second leg.

12. A rodless cylinder according to claim 11, wherein said slit is located on a side of said cylinder body facing said second leg of said L-shaped sliding table.

13. A rodless cylinder according to claim 2, wherein said support member includes a slanted surface being subject to a load imposed from one of a direction over said first surface and a direction over said second surface of said sliding table.

14. A rodless cylinder according to claim 13, wherein said guide member has at least two surfaces which are separately slanted with respect to each other, said support member having slanted surfaces facing said surfaces of said guide member, said slanted surfaces of said support member being subject to load imposed from one of a direction over said first surface of said second surface and a direction over said sliding table.

* * * * *